US011578587B2

(12) United States Patent
Carroll et al.

(10) Patent No.: US 11,578,587 B2
(45) Date of Patent: Feb. 14, 2023

(54) ANALYSIS OF WELL OPERATIONS USING WELLHEAD DATA

(71) Applicant: Chevron U.S.A. Inc., San Ramon, CA (US)

(72) Inventors: Caleb Kimbrell Carroll, Spring, TX (US); Jay Patrick Painter, League City, TX (US); Douglas Ryan Nally, Houston, TX (US); Sarvesh Kumar Tyagi, Spring, TX (US); Benjamin Ames Leonard, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 15/929,490

(22) Filed: May 5, 2020

(65) Prior Publication Data

US 2021/0348505 A1 Nov. 11, 2021

(51) Int. Cl.

| | |
|---|---|
| ***E21B 47/06*** | (2012.01) |
| ***E21B 33/06*** | (2006.01) |
| ***E21B 47/07*** | (2012.01) |
| ***E21B 47/09*** | (2012.01) |

(52) U.S. Cl.

CPC ..... *E21B 47/06* (2013.01); *E21B 33/06* (2013.01); *E21B 47/07* (2020.05); *E21B 47/09* (2013.01)

(58) Field of Classification Search

CPC ..... E21B 47/06; E21B 47/07; E21B 47/09; E21B 33/06

USPC ..... 73/152.55

See application file for complete search history.

(56) References Cited

U.S. PATENT DOCUMENTS

| | | | | |
|---|---|---|---|---|
| 8,560,098 | B1 * | 10/2013 | Chapman | G01N 11/00 700/83 |
| 9,322,247 | B2 * | 4/2016 | Rojas | E21B 44/00 |
| 9,546,545 | B2 * | 1/2017 | Cardellini | E21B 47/007 |
| 10,378,333 | B2 * | 8/2019 | Dawson | E21B 47/06 |
| 2013/0087388 | A1 * | 4/2013 | Veeningen | E21B 47/06 175/48 |
| 2014/0311735 | A1 * | 10/2014 | Landrith, II | E21B 34/16 166/250.04 |
| 2018/0096277 | A1 * | 4/2018 | Maidla | G06Q 10/06393 |
| 2018/0128101 | A1 * | 5/2018 | Ledroz | E21B 47/00 |
| 2018/0238467 | A1 * | 8/2018 | Sundar | G01M 3/02 |
| 2019/0128112 | A1 * | 5/2019 | Spicer | E21B 43/26 |

FOREIGN PATENT DOCUMENTS

| | | | | |
|---|---|---|---|---|
| WO | WO-2021126963 | A1 * | 6/2021 | E21B 43/26 |

OTHER PUBLICATIONS

SOR Measurement and Control "Well Monitoring Systems", pp. 1-8. https://www.sorinc.com/assets/images/uploads/2012/06/SENSOR-Well-Monitoring-Systems-BRO1686.pdf accessed Nov. 10, 2021 (Year: 2016).*

(Continued)

*Primary Examiner* — Nimeshkumar D Patel
*Assistant Examiner* — Jean F Morello
(74) *Attorney, Agent, or Firm* — Esplin & Associates, PC

(57) ABSTRACT

Sensors may be located remotely from a rig of a well. The sensors may operate independently of the rig, and generate remote sensor information that characterizes operating characteristics of the well independent of the rig. The operation of the well may be analyzed based on the remote sensor information.

19 Claims, 6 Drawing Sheets

(56) References Cited

OTHER PUBLICATIONS

Signalfire "Monitoring Wellhead Tubing and Casing Pressures Simplified with SignalFire Pressure Scout", https://signal-fire.com/monitoring-wellhead-tubing-and-casing-pressures-simplified-with-signalfire-pressure-scout/ accessed Nov. 10, 2021 (Year: 2018).*
Emerson "Improve Wellhead Cost Effectiveness and Safety with Remote Monitoring Solutions" https://www.emerson.com/documents/automation/flyer-protect-wellhead-integrity-wireless-monitoring-en-6528692.pdf accessed Nov. 10, 2021 (Year: 2020).*
Djamaluddin, et al., Petrolink Inernational, Real-Time Drilling Operation Activity Analysis Data Modelling with Multidimensional Approach and Column-Oriented Storage; Society of Petroleum Engineers, SPE-194701-MS (pp. 1-13).
Ouahrani, et al., Invisible Lost Time measurement and reduction contributes to optimizing total well time by improving ROP and reducing flat time; Society of Petroleum Engineers, SPE-192319-MS (pp. 1-15).

* cited by examiner

ANALYSIS OF WELL OPERATIONS USING WELLHEAD DATA

FIELD

The present disclosure relates generally to the field of analyzing well operations using sensor data acquired remotely from a rig.

BACKGROUND

Rig-specific data may be used to identify rig state for a well. Rig-specific data may not provide information to analyze other operations at the well.

SUMMARY

This disclosure relates to analyzing well operations. Remote sensor information for a well and/or other information may be obtained. The remote sensor information may be generated by a set of sensors located remotely from a rig of the well. The set of sensors may operate independently of the rig. The remote sensor information may characterize one or more operating characteristics of the well and enable analysis of operation of the well independently of the rig. The operation of the well may be analyzed based on the remote sensor information and/or other information.

A system that analyzes well operations may include one or more electronic storage, one or more processors and/or other components. The electronic storage may store remote sensor information, information relating to a well, information relating to sensors, information relating to operating characteristics of a well, information relating to analysis of operation of a well, and/or other information.

The processor(s) may be configured by machine-readable instructions. Executing the machine-readable instructions may cause the processor(s) to facilitate analyzing well operations. The machine-readable instructions may include one or more computer program components. The computer program components may include one or more of a remote sensor component, an analysis component, and/or other computer program components.

The remote sensor component may be configured to obtain remote sensor information for a well and/or other information. The remote sensor information for a well may be generated by a set of sensors. The set of sensors may be located remotely from a rig of the well. The set of sensors may operate independently of the rig. The remote sensor information may characterize one or more operating characteristics of the well. The remote sensor information may enable analysis of operation of the well independently of the rig.

In some implementations, the set of sensors may be located at a wellhead, a blowout preventer, and/or a tree of the well. In some implementations, the set of sensors may include one or more of a pressure sensor, a temperature sensor, a motion sensor, a location sensor, a valve position sensor, a proximity sensor, and/or other sensors.

In some implementations, the well may include a wellhead. A blowout preventer or a tree may be attached to the wellhead via an adaptor. The set of sensors may include a first pressure sensor located at the wellhead and a second pressure sensor located at the adaptor.

The analysis component may be configured to analyze the operation of the well. The operation of the well may be analyzed based on the remote sensor information and/or other information. In some implementations, the operation of the well may include a drilling operation, a completion operation, a production operation, and/or other operation.

In some implementations, analyzing the operation of the well based on the remote sensor information may include benchmarking of flat time operations and/or offline operations based on the remote sensor information. In some implementations, analyzing the operation of the well based on the remote sensor information may include monitoring of one or more well operation parameters based on the remote sensor information.

In some implementations, analyzing the operation of the well based on the remote senor information may include: responsive to the remote sensor information providing information sufficient to determine well state, determining the well state based on the remote sensor information; and responsive to the remote sensor information providing information insufficient to determine the well state, determining the well state based on the remote sensor information and rig sensor information.

In some implementations, the set of sensors may include the first pressure sensor located at the wellhead and the second pressure sensor located at the adaptor, and analyzing the operation of the well based on the remote sensor information may include determining a well state based on comparison of a first pressure read by the first pressure sensor and a second pressure read by the second pressure sensor. In some implementations, the well state may include a completion state or a frack state.

In some implementations, the set of sensors may include the proximity sensor; and analyzing the operation of the well based on the remote sensor information may include identification of the well based on an IP address conveyed by the remote sensor information.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a," "an," and "the" include plural referents unless the context clearly dictates otherwise.

DETAILED DESCRIPTION

The present disclosure relates to analyzing well operations. Sensors may be located remotely from a rig of a well.

The sensors may operate independently of the rig, and generate remote sensor information that characterizes operating characteristics of the well independent of the rig. The operation of the well may be analyzed based on the remote sensor information.

Figure 1:
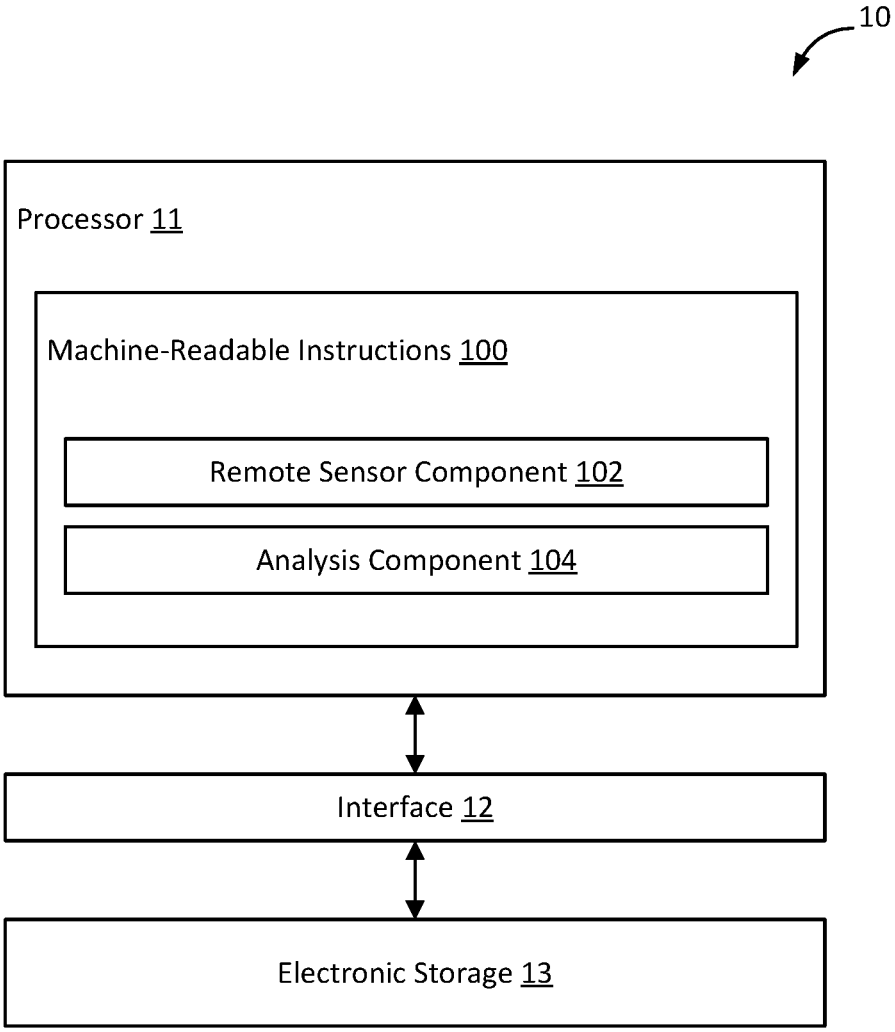
FIG. 1 illustrates an example system that analyzes well operations.

The methods and systems of the present disclosure may be implemented by and/or in a computing system, such as a system 10 shown in FIG. 1. The system 10 may include one or more of a processor 11, an interface 12 (e.g., bus, wireless interface), an electronic storage 13, and/or other components. Remote sensor information for a well and/or other information may be obtained by the processor 11. The remote sensor information may be generated by a set of sensors located remotely from a rig of the well. The set of sensors may operate independently of the rig. The remote sensor information may characterize one or more operating characteristics of the well and enable analysis of operation of the well independently of the rig. The operation of the well may be analyzed by the processor 11 based on the remote sensor information and/or other information.

The electronic storage 13 may be configured to include electronic storage medium that electronically stores information. The electronic storage 13 may store software algorithms, information determined by the processor 11, information received remotely, and/or other information that enables the system 10 to function properly. For example, the electronic storage 13 may store remote sensor information, information relating to a well, information relating to sensors, information relating to operating characteristics of a well, information relating to analysis of operation of a well, and/or other information.

The processor 11 may be configured to provide information processing capabilities in the system 10. As such, the processor 11 may comprise one or more of a digital processor, an analog processor, a digital circuit designed to process information, a central processing unit, a graphics processing unit, a microcontroller, an analog circuit designed to process information, a state machine, and/or other mechanisms for electronically processing information. The processor 11 may be configured to execute one or more machine-readable instructions 100 to facilitate analyzing well operations. The machine-readable instructions 100 may include one or more computer program components. The machine-readable instructions 100 may include one or more of a remote sensor component 102, an analysis component 104, and/or other computer program components.

The remote sensor component 102 may be configured to obtain remote sensor information for a well and/or other information. Obtaining remote sensor information for a well may include one or more of accessing, acquiring, analyzing, determining, examining, identifying, loading, locating, opening, receiving, retrieving, reviewing, selecting, storing, utilizing, and/or otherwise obtaining the remote sensor information. The remote sensor component 102 may be configured to obtain remote sensor information for a well from one or more locations. For example, the remote sensor component 102 may obtain remote sensor information for a well from a storage location, such as the electronic storage 13, electronic storage of a device accessible via a network, and/or other locations. The remote sensor component 102 may obtain remote sensor information for a well from one or more hardware components (e.g., a computing device, a component of a computing device, a sensor, a component of a drilling tool) and/or one or more software components (e.g., software running on a computing device). Remote sensor information for a well may be stored within a single file or multiple files.

A well may refer to a hole or a tunnel in the ground. A well may be drilled in one or more directions. For example, a well may include a vertical well, a horizontal well, a deviated well, and/or other type of well. A well may be drilled in the ground for exploration and/or recovery of natural resources in the ground. For example, a well may be drilled in the ground to aid in extraction of petrochemical fluid (e.g., oil, gas, petroleum, fossil fuel). As another example, a well may be drilled in the ground for fluid injection. Application of the present disclosure to other types of wells and wells drilled for other purposes are contemplated.

The remote sensor information may characterize one or more operating characteristics of the well. An operating characteristic of a well may refer to one or more features and/or one or more qualities of the well during operation of the well. Operation of a well may refer to performance of work on and/or usage of a well. Operation of a well may be divided into different stages and/or types of operation. For example, operation of the well may include a drilling operation, a completion operation, a production operation, or other operation of the well. The remote sensor information may characterize operation characteristic(s) of a well during a drilling operation, a completion operation, a production operation, and/or other operation of the well. In some implementations, the remote sensor information may include high frequency data read by the set of sensors.

An operating characteristic of a well may include one or more values of operating parameter(s) that define the operation of the well. An operating characteristic of a well may include status of how a well is being used. An operating characteristic of a well may include one or more conditions of materials of, within, around, and/or near the well. An operating characteristic of a well may include one or more values of environmental condition(s) of, within, around, and/or near the well. An operating characteristic of a well may include one or more parameter values (e.g., continuous values, categorical values) of tool(s) used in the operation of the well. For example, an operating characteristic of a well may include parameter value(s) of the tool(s) that are controlled and/or set to operate the tool(s) in a particular manner and perform the operation of the well. An operating characteristic of a well may include one or more parameter values (e.g., continuous values, categorical values) of sensor(s) used to monitor the operation of the well. For example, an operating characteristic of a well may include parameter value(s) of the sensor(s) that monitor how tools for a drilling operation, a completion operation, a production operation, and/or other operation of the well are being used and/or how using of such tools impact the well.

The remote sensor information may characterize operating characteristics of a well by including information that characterizes (e.g., reflects, quantifies, identifies, defines) one or more values, qualities, attributes, features, and/or other aspects of the operating characteristics of the well. For example, the remote sensor information may characterize operating characteristics of a well by including information that makes up and/or is used to determine values, characters, and/or symbols of the operating characteristics. Other types of remote sensor information are contemplated.

The remote sensor information for a well may be generated by a set of sensors. The set of sensors may include one or more sensors. A sensor may refer to a device that monitors (e.g., measures, ascertains, detects, estimates) one or more physical properties. A sensor may include a device (e.g., transducer) that converts the monitored physical propert(ies) into output (e.g., electrical signals conveying remote sensor information). For example, the set of sensors may include one or more of a pressure sensor, a temperature sensor, a motion sensor (e.g., accelerometer, IMU), a location sensor (e.g., GPS unit), an orientation sensor (e.g., magnetometer)), a valve position sensor, a proximity sensor, and/or other sensors. In some implementations, the set of sensors may include one or more communication devices that enable the set of sensors to remotely communicate the remote sensor information to other device(s) (e.g., to the system 10).

The set of sensors may be located remotely from a rig of the well. A rig of a well may refer to a rig on the well and/or a rig that is, will be, and/or has been used on the well. For example, a rig may be on the well to facilitate one or more operations of the well, and the set of sensors may be located remotely from the rig on the well to generate the remote sensor information. As another example, the rig may be removed from the well after one or more operations of the well, and the set of sensor may be located remotely from the rig to generate the remote sensor information.

Using data from sensors on the rig and/or other tools (e.g., standard rig instrumentation) used in well operations may limit types of well operation analysis that may be performed. For example, rig specific data (e.g., draw works movement, hookload, pump rate, pump pressure, TDS/KB RPM, TDS/KB Torque) may be used to identify rig state, but such analysis may be limited to the most common rig data captured on a conventional geolograph or digital system. Rig specific data may provide information to perform analysis of rig utilization, but may not enable analysis of well operation in general. Data provided by the set of sensors described herein may provide new type of well operation data that enables new and/or different types of well operation analysis. Data provided by the set of sensors described herein may include data not observable from the rig and/or other tools used in well operations.

Using data from sensors on the rig and/or other tools (e.g., standard rig instrumentation) used in well operations may limit when well operation analysis may be performed. For example, absence of the rig from the well and/or non-operation of the rig on the well may result in sensors on the rig not generating sensor data for the rig and/or the well. Data provided by the set of sensors described herein may provide well operation data that enables well operation analysis for times when the rig is not present and/or not in operation. Data provided by the set of sensors described here may provide well operation data for tasks that are not recorded by sensors from standard sensor locations. Data provided by the set of sensors described herein may be captured from non-standard sensor locations and may enable analysis (e.g., performance benchmarking) of such tasks on and around the well.

The set of sensors disclosed herein may operate independently of the rig. The set of sensor may operate independently of the rig to generate the remote sensor information. The set of sensors operating independently of the rig may include the set of sensors operating to generate the remote sensor information regardless of whether or not the rig is on the well. The set of sensors operating independently of the rig may include the set of sensors operating to generate the remote sensor information regardless of whether or not the rig is in operation.

The set of sensors operating independently of the rig may result in generation of the remote sensor information, which may enable analysis of the operation of the well independently of the rig. The set of sensors operating independently of the rig may include the set of sensors generating the remote sensor independent regardless of whether the rig is operating or not. The set of sensors operating independently of the rig may include the set of sensors generating the remote sensor independent regardless of whether the rig is on the well or not. For example, the rig may not be operating or may not be on the rig. The remote sensor information generated by the set of sensors may be used to perform analysis of a drilling operation, a completion operation, a production operation, and/or other operation of the well. The remote sensor information generated by the set of sensors may enable generation of a data set that may be used to determine the operational state at and/or around the well for drilling, completion, and/or production operations.

For example, the set of sensors may be located at a wellhead, a blowout preventer, a tree (e.g., Christmas tree, frack tree), and/or flowline equipment of the well. A wellhead may refer to one or more components at the surface of the well that provides structural and/or pressure-containing interface for drilling and production equipment. For example, a wellhead may include spools, valves, and/or adapters that provide pressure control of a production well. A wellhead may allow for installation of a tree and flow-control facilities for production. A blowout preventer may refer to a valve and/or other mechanical device used to seal, control, and/or monitor a well to prevent blowouts (e.g., uncontrolled release of oil or gas from the well). A tree may refer to an assembly of valves, spools, and/or fittings used to regulate flow of pipes in a well. A tree may be connected to the top of a well to direct and/or control the flow of fluid from the well. A tree may be used to control production from a well. Flowline equipment may refer to metal pipe(s) that carry flow of materials to and/or from a well. Flowline equipment may refer to pipeline carrying oil, gas, or water that connects a wellhead to a manifold and/or to production facilities. Placement of sensors at other non-standard locations are contemplated.

The remote sensor information may be used separately from and/or with other information (e.g., standard sensor data). For example, remote sensor information may include (1) pressure and/or temperature data, (2) proximity switch data, (3) valve position data, and/or (4) location data from sensors located on the wellhead, the blowout preventer, the tree, and/or the flowline equipment of the well. Standard sensor information may include data from blowout preventer control systems, and/or data from rig sensors, frack unit sensors, and/or coil tubing sensors. The remote sensor formation may be used independently of the standard sensor information to perform well operation analysis. The remote sensor formation may be used with the standard sensor information to perform well operation analysis.

Figure 3:
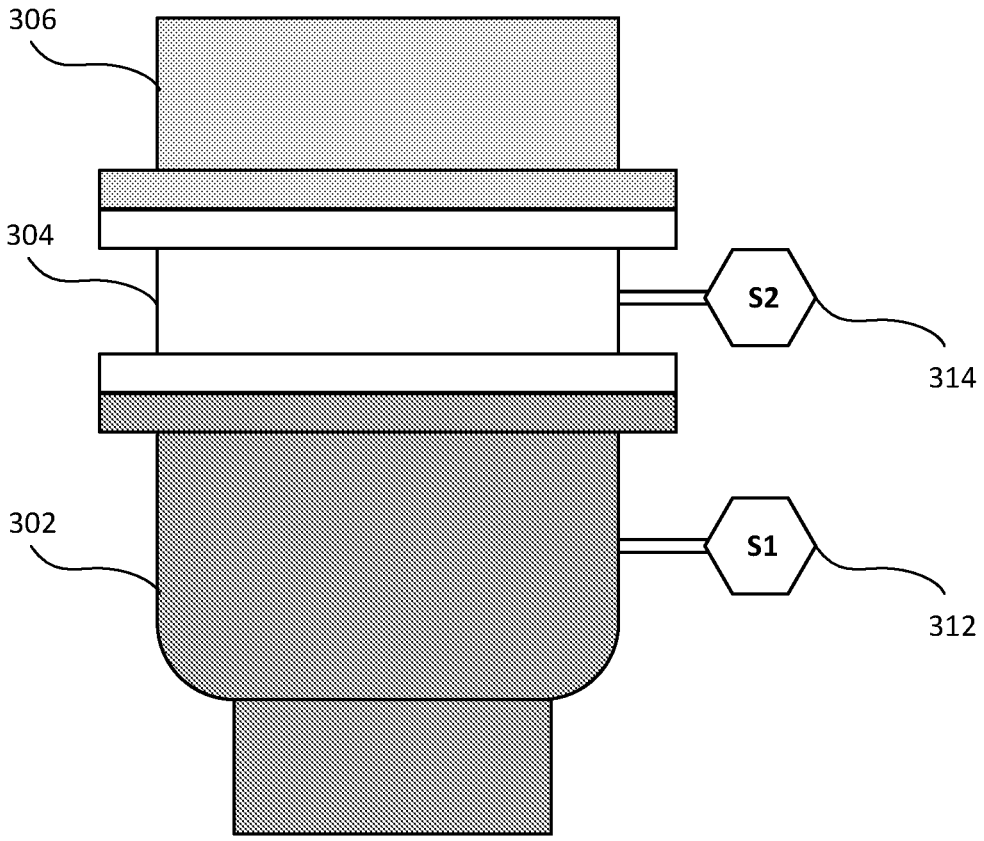
FIG. 3 illustrates an example placement of sensors.

FIG. 3 illustrates an example placement of sensors. In FIG. 3, a wellhead 302 may be installed on top of a well. An adaptor/spool 304 may be attached to the top of the wellhead 302. Equipment 306 (e.g., blowout preventer, tree) may be attached to the adaptor/spool 304. For instance, a blowout preventer or a tree may be attached to the wellhead 302 via the adaptor/spool 304. A set of sensors may be placed on the wellhead 302, the adaptor/spool 304, and/or the equipment 306 to generate remote sensor information. For example, a sensor 312 may be located at the wellhead 312 and a sensor 314 may be located at the adaptor/spool 304. The sensors 312, 314 may be the same type or different types of sensors. For example, the sensors 312, 314 may include pressure sensors, and pressures read by the sensors 312 at the wellhead 312 and by the sensor 314 at the adaptor/spool 304 may be used to analyze operation of the well.

Figure 4:
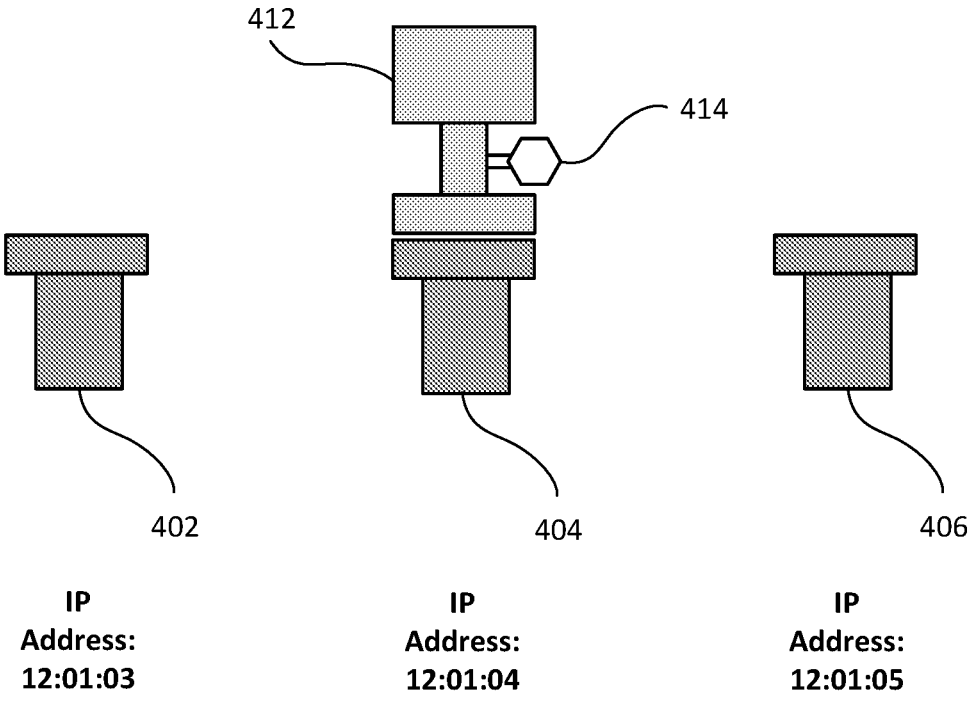
FIG. 4 illustrates an example placement of a proximity sensor.

FIG. 4 illustrates an example placement of a proximity sensor 414. FIG. 4 may show three wells 402, 404, 406. The proximity sensor 414 may be attached to equipment 412

(e.g., wellhead, blowout preventer, tree) that may be positioned on top of the wells 402, 404, 406. The wells 402, 404, 406 may be associated with different IP addresses. IP address detected by the proximity sensor 414 may be used to analyze the operation of one or more of the wells 402, 404, 406.

Figure 5:
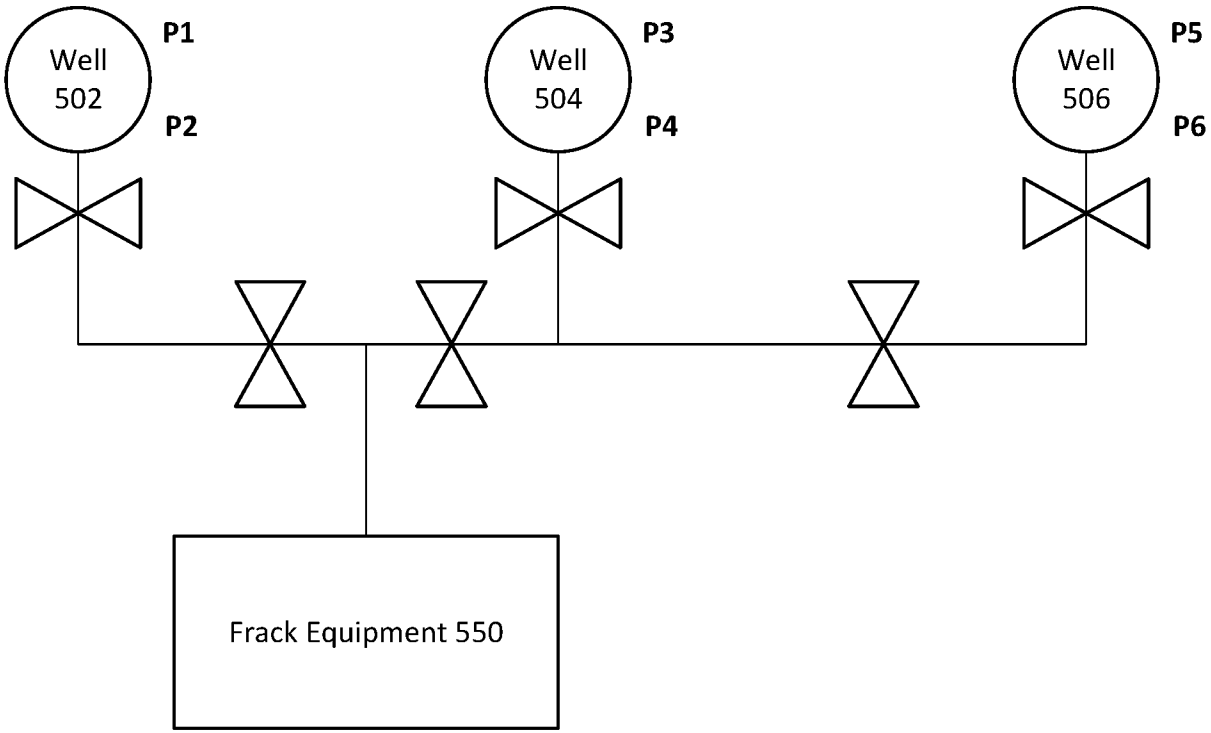
FIG. 5 illustrates an example placement of pressure sensors.

FIG. 5 illustrates an example placement of pressure sensors. FIG. 5 may show three wells 502, 504, 506, frack equipment 550, and connections between the wells 502, 504, 506 and the frack equipment 550. Multiple pressure sensors may be located at individual wells 502, 504, 506, such as shown in FIG. 3. Multiple pressure sensors may provide two separate pressure readings for individual wells 502, 504, 506 (P1 and P2 for well 502, P3 and P4 for well 504, P5 and P6 for well 506). Use of other sensors and other placements of sensors are contemplated.

The analysis component 104 may be configured to analyze the operation of the well. Analyzing the operation of the well may include examining, monitoring, processing, studying, classifying, and/or other analysis of the operation of the well. The operation of the well may be analyzed based on the remote sensor information and/or other information. The operation of the well may be analyzed based on the remote sensor information generated by the set of sensor located remotely from the rig of the well and operating independent of the rig. The operation of the well may include a drilling operation, a completion operation, a production operation, and/or other operation of the well. For example, the remote sensor information may be filtered and analyzed to perform remote monitoring and/or analytics of the well, and/or to determine the activity state of operations on and/or around the well. Analysis of the operation of the well may include leveraging high frequency data contained within and/or conveyed by the remote sensor information to measure and/or improve operation of the well using real-time measurements.

In some implementations, analyzing the operation of the well based on the remote sensor information may include benchmarking of flat time operations and/or offline operations based on the remote sensor information. For example, for rig-based operations, analyzing the operation of the well based on the remote sensor information may include using the remote sensor information to benchmark flat time operations and/or offline operations to better define critical paths of the drilling operation. For instance, use of remote sensor information to analyze well operation may enable flat time, rather than drilling specific operations, to be improved.

In some implementations, analyzing the operation of the well based on the remote sensor information may include monitoring of one or more well operation parameters based on the remote sensor information. A well operation parameter may include one or more features and/or qualities of the well. A well operation parameter may refer to a numerical and/or other measurable factor that defines operation of the well and/or sets the conditions of operation of the well. A well operation parameter may include a parameter applied and/or used to operate a tool for the well and/or a condition of the environment around/near the tool/well during operation. For example, a well operation parameter may include parameters of the well, parameters of tools for the well, and/or parameters of other things that affect the well.

For example, for completion operation, the analysis of the operation of the well based on the remote sensor information may include monitoring of frack operation verses wireline operation, as well as annuli pressure monitoring (e.g., to ensure integrity of casing strings). Diagnostic fracture injection test and pressure monitoring may be used to facilitate measurement of well construction reliability and completion integrity from the start of the well life. Other analysis of the operation of the well based on the remote sensor information are contemplated.

One or more logics may be utilized to perform the analysis based on sensor readings. For example, referring to FIG. 3, sensor reading (S1) from the sensor 312 may be compared with sensor reading (S2) from the sensor 314 to perform analysis of the operation of the well. For instance, two sensor readings being the same or approximately the same (e.g., one sensor reading being within a threshold value of the other sensor reading) may indicate one state of well operation (S1=S2->State A), while one sensor reading being greater than the other sensor reading may indicate another state of well operation (S1>S2->State B).

For instance, the sensors 312, 314 may be pressure sensors, and the equipment 306 may include a blowout preventer. Analyzing the operation of the well based on the remote sensor information may include determining a well state (e.g., differentiation between a completion state and a frack state) based on comparison of pressure read by the sensor 312 and pressure read by the sensor 314. Same/approximately the same pressure readings from the sensors 312, 314 (P1=P2) may indicate that the blowout preventer is nippled up (installed or flanged up). Pressure reading from the sensor 312 being greater than the pressure reading from the sensor 314 (P1>P2) may indicate that the blowout preventer is not nippled up. The comparison of pressure readings from the sensors 312, 314 may be used to determine when nipple up occurs (e.g., indicating presence of hydrostatic column of water and full stack) and when nipple down occurs (e.g., indicating draining of the stack). If pressure reading from the sensor 312 is almost equal to the pressure reading from the sensor 314, which is less than hydrostatic pressure of air gap of mud weight (P1 almost=P2<HPagmw), then the well may be in a drilling rig mode (static). If pressure reading from the sensor 312 is almost equal to the pressure reading from the sensor 314, which is greater than hydrostatic pressure of air gap of mud weight (P1 almost=P2>HPagmw), then the well may be in drilling (dynamic). Other use of pressure sensor readings are contemplated.

As another example, referring to FIG. 4, analyzing the operation of the well based on the remote sensor information may include identification of the well based on an IP address conveyed by the remote sensor information. For instance, proximity reading from the proximity sensor 414 may be used to determine location of the equipment 412 (e.g., on which of the wells 402, 404, 406 the equipment 412 is positioned/being utilized). For example, the equipment 412 may include a blowout preventer, and the proximity sensor 414 may include an addressable proximity switch. Location of the blowout preventer on one of the wells 402, 404, 406 may be determined based on the proximity reading from the proximity sensor 414 indicating proximity to equipment with particular IP address. For example, if the proximity reading indicates proximity of the proximity sensor 414 to equipment with IP address 12:01:04, then the blowout preventer may be determined to be on the well 404.

FIG. 5 provide an example use of pressure sensor readings for well state determination. In FIG. 5, multiple pressure sensors may provide two separate pressure readings for individual wells 502, 504, 506 (P1 and P2 for well 502, P3 and P4 for well 504, P5 and P6 for well 506). The well 502 may be determined to be a frack well based on the corresponding two pressure readings being equal and being within a frack pressure range (P1=P2=frack pressure range- >frack well). Count of the corresponding two pressure readings being equal and being within a frack pressure range may be used to determine sum of frack stages per well ((P1=P2=frack pressure range)(count)=sum of frack stages per well). The well 506 may be determined to be undergoing wireline operations based on the corresponding two pressure readings being equal and matching a wireline pump down pressure (P5=P6=wireline pump down pressure->wireline operations). The well 504 may be determined to be a static well based on the corresponding two pressure readings being the same, while not being the same as P1 or P5 (P3=P4≠P1, P3=P4≠P5). Stress shadow risk of the well 502 (frack well) may be determined based on the two pressure readings of the well 504 being equal to each other while being greater than static pressure (P3=P4>static pressure->frack well stress shadow risk). Use of other logics to perform analysis based on sensor readings are contemplated.

The remote sensor information may be used with other sensor information to perform well operation analysis. Other sensor information may include sensor information generated by standard sensors in standard sensor locations. For example, other sensor information may include rig sensor information generated by sensor(s) of a rig. In some implementations, the operation of the well may be analyzed using the remote sensor information without other sensor information responsive to the remote sensor information providing sufficient information to determine the well state. Responsive to the remote sensor information providing information insufficient to determine the well state, the well state may be determined based on both the remote sensor information and other sensor information (e.g., rig sensor information). Thus, the remote sensor information may be merged with standard sensor information to perform analysis of well operations.

Figure 6:
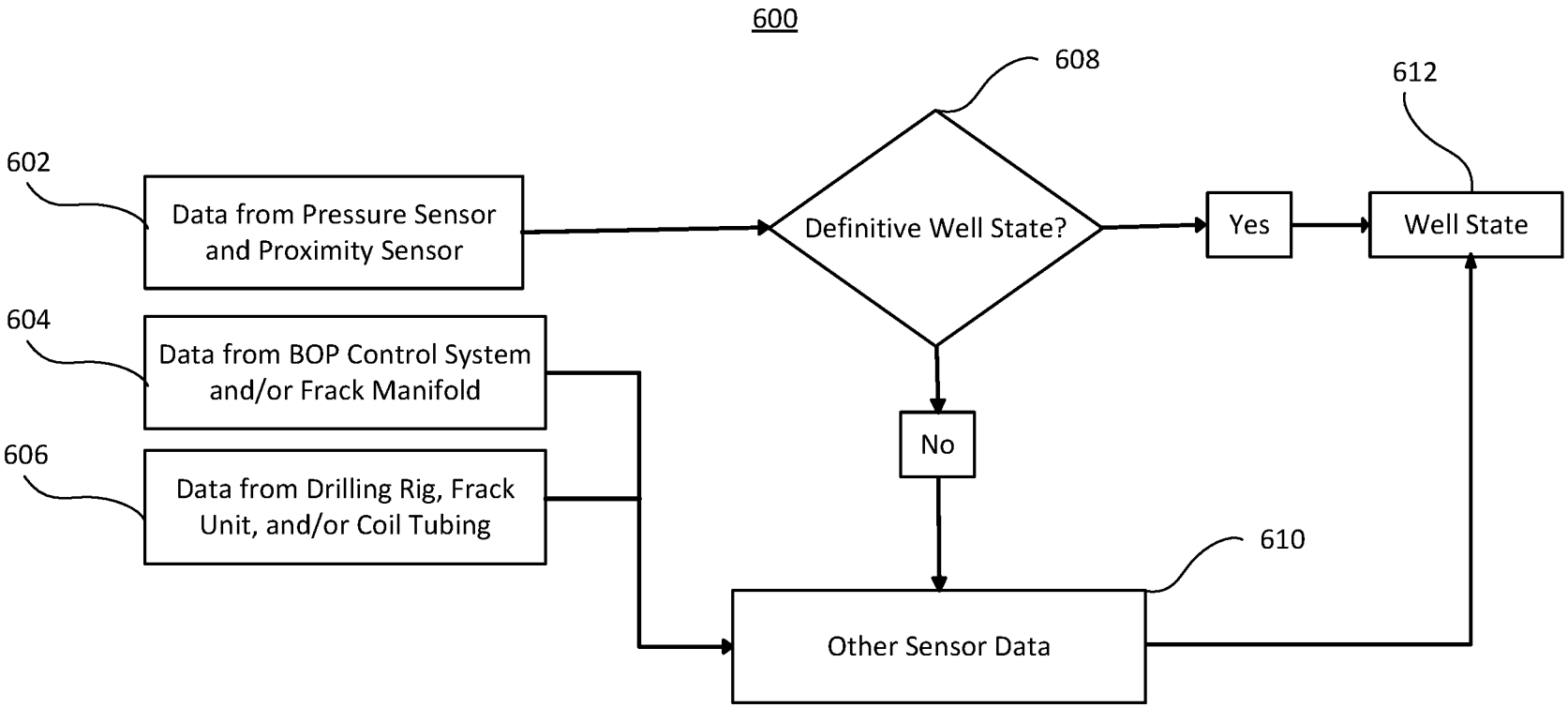
FIG. 6 illustrates example uses of different sensor information.

FIG. 6 illustrates example uses of different sensor information. Remote sensor information may include data from pressure sensor and proximity sensor 602 located remotely from and operating independently of a rig. Other sensor data 610 (e.g., standard sensor information) may include data from blowout prevent control system and/or frack manifold 604 and data from drilling rig, frack unit, and/or coil tubing 606. If definitive well state 608 can be determined from the data 602, then the analysis of the well operation may proceed to determination of the well state 612. If definitive well state 608 cannot be determined from the data 602, then the determination of the well state 612 may be performed using the other sensor data 610. Using the other sensor data 610 to determine the well state may include using the other sensor data 610 with or without the data 602. For example, if sensor data collected from non-standard sensor locations is not able to definitively determine well state, then sensor data collected from standard sensor locations may be used instead. As another example, if sensor data collected from non-standard sensor locations is not able to definitively determine well state, then sensor data collected from standard sensor location may be merged with sensor data collected from non-standard sensor locations to determine the well state. Such merged sensor data may provide a more detailed/complete understanding of the well state.

Implementations of the disclosure may be made in hardware, firmware, software, or any suitable combination thereof. Aspects of the disclosure may be implemented as instructions stored on a machine-readable medium, which may be read and executed by one or more processors. A machine-readable medium may include any mechanism for storing or transmitting information in a form readable by a machine (e.g., a computing device). For example, a tangible computer-readable storage medium may include read-only memory, random access memory, magnetic disk storage media, optical storage media, flash memory devices, and others, and a machine-readable transmission media may include forms of propagated signals, such as carrier waves, infrared signals, digital signals, and others. Firmware, software, routines, or instructions may be described herein in terms of specific exemplary aspects and implementations of the disclosure, and performing certain actions.

In some implementations, some or all of the functionalities attributed herein to the system 10 may be provided by external resources not included in the system 10. External resources may include hosts/sources of information, computing, and/or processing and/or other providers of information, computing, and/or processing outside of the system 10.

Although the processor 11 and the electronic storage 13 are shown to be connected to the interface 12 in FIG. 1, any communication medium may be used to facilitate interaction between any components of the system 10. One or more components of the system 10 may communicate with each other through hard-wired communication, wireless communication, or both. For example, one or more components of the system 10 may communicate with each other through a network. For example, the processor 11 may wirelessly communicate with the electronic storage 13. By way of non-limiting example, wireless communication may include one or more of radio communication, Bluetooth communication, Wi-Fi communication, cellular communication, infrared communication, or other wireless communication. Other types of communications are contemplated by the present disclosure.

Although the processor 11 is shown in FIG. 1 as a single entity, this is for illustrative purposes only. In some implementations, the processor 11 may comprise a plurality of processing units. These processing units may be physically located within the same device, or the processor 11 may represent processing functionality of a plurality of devices operating in coordination. The processor 11 may be separate from and/or be part of one or more components of the system 10. The processor 11 may be configured to execute one or more components by software; hardware; firmware; some combination of software, hardware, and/or firmware; and/or other mechanisms for configuring processing capabilities on the processor 11.

It should be appreciated that although computer program components are illustrated in FIG. 1 as being co-located within a single processing unit, one or more of computer program components may be located remotely from the other computer program components. While computer program components are described as performing or being configured to perform operations, computer program components may comprise instructions which may program processor 11 and/or system 10 to perform the operation.

While computer program components are described herein as being implemented via processor 11 through machine-readable instructions 100, this is merely for ease of reference and is not meant to be limiting. In some implementations, one or more functions of computer program components described herein may be implemented via hardware (e.g., dedicated chip, field-programmable gate array) rather than software. One or more functions of computer program components described herein may be software-implemented, hardware-implemented, or software and hardware-implemented.

The description of the functionality provided by the different computer program components described herein is for illustrative purposes, and is not intended to be limiting, as any of computer program components may provide more or less functionality than is described. For example, one or more of computer program components may be eliminated, and some or all of its functionality may be provided by other computer program components. As another example, processor 11 may be configured to execute one or more additional computer program components that may perform some or all of the functionality attributed to one or more of computer program components described herein.

The electronic storage media of the electronic storage 13 may be provided integrally (i.e., substantially non-removable) with one or more components of the system 10 and/or as removable storage that is connectable to one or more components of the system 10 via, for example, a port (e.g., a USB port, a Firewire port, etc.) or a drive (e.g., a disk drive, etc.). The electronic storage 13 may include one or more of optically readable storage media (e.g., optical disks, etc.), magnetically readable storage media (e.g., magnetic tape, magnetic hard drive, floppy drive, etc.), electrical charge-based storage media (e.g., EPROM, EEPROM, RAM, etc.), solid-state storage media (e.g., flash drive, etc.), and/or other electronically readable storage media. The electronic storage 13 may be a separate component within the system 10, or the electronic storage 13 may be provided integrally with one or more other components of the system 10 (e.g., the processor 11). Although the electronic storage 13 is shown in FIG. 1 as a single entity, this is for illustrative purposes only. In some implementations, the electronic storage 13 may comprise a plurality of storage units. These storage units may be physically located within the same device, or the electronic storage 13 may represent storage functionality of a plurality of devices operating in coordination.

Figure 2:
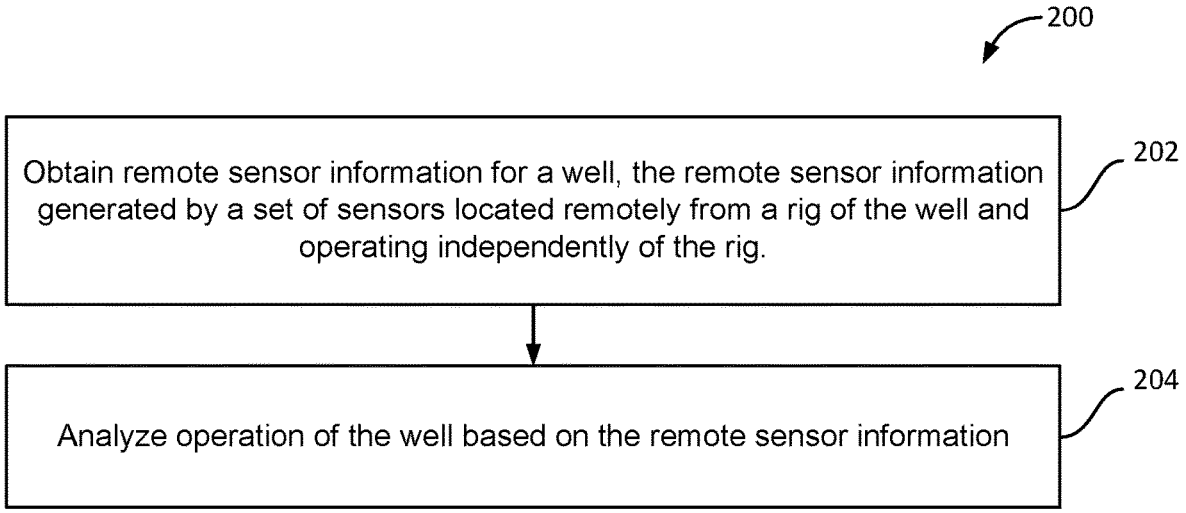
FIG. 2 illustrates an example method for analyzing well operations.

FIG. 2 illustrates method 200 for analyzing well operations. The operations of method 200 presented below are intended to be illustrative. In some implementations, method 200 may be accomplished with one or more additional operations not described, and/or without one or more of the operations discussed. In some implementations, two or more of the operations may occur substantially simultaneously.

In some implementations, method 200 may be implemented in one or more processing devices (e.g., a digital processor, an analog processor, a digital circuit designed to process information, a central processing unit, a graphics processing unit, a microcontroller, an analog circuit designed to process information, a state machine, and/or other mechanisms for electronically processing information). The one or more processing devices may include one or more devices executing some or all of the operations of method 200 in response to instructions stored electronically on one or more electronic storage media. The one or more processing devices may include one or more devices configured through hardware, firmware, and/or software to be specifically designed for execution of one or more of the operations of method 200.

Referring to FIG. 2 and method 200, at operation 202, remote sensor information for a well and/or other information may be obtained. The remote sensor information may be generated by a set of sensors located remotely from a rig of the well. The set of sensors may operate independently of the rig. The remote sensor information may characterize one or more operating characteristics of the well and enable analysis of operation of the well independently of the rig. In some implementation, operation 202 may be performed by a processor component the same as or similar to the remote sensor component 102 (Shown in FIG. 1 and described herein).

At operation 204, the operation of the well may be analyzed based on the remote sensor information and/or other information. In some implementation, operation 204 may be performed by a processor component the same as or similar to the analysis component 104 (Shown in FIG. 1 and described herein).

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A system that analyzes well operations, the system comprising:

a first pressure sensor located at a wellhead of a well, the first pressure sensor operating independently of a rig of the well to generate a first pressure reading at the wellhead regardless of operational status of the rig;

a second pressure sensor located at an adaptor or a spool of the well, the second pressure sensor operating independently of the rig of the well to generate a second pressure reading at the adaptor or the spool regardless of operational status of the rig;

one or more physical processors configured by machine-readable instructions to:

obtain remote sensor information for the well, the well including the wellhead, a blowout preventor or a tree attached to the wellhead via the adaptor or the spool, the remote sensor information generated by a set of sensors including the first pressure sensor located at the wellhead and the second pressure sensor located at the adaptor or the spool, the set of sensors operating independently of the rig to generate the remote sensor information when the rig is not on the well or when the rig is not in operation, the remote sensor information characterizing one or more operating characteristics of the well and enabling analysis of operation of the well to differentiate between different types of well state when the rig is not on the well or when the rig is not in operation, the remote sensor information including the first pressure reading from the first pressure sensor located at the wellhead and the second pressure reading from the second pressure sensor located at the adaptor or the spool; and analyze the operation of the well based on the remote sensor information, the analysis of the operation of the well based on the remote sensor information including differentiation between the different types of well state based on comparison of the first pressure reading from the first pressure sensor located at the wellhead and the second pressure reading from the second pressure sensor located at the adaptor or the spool, the first pressure reading and the second pressure reading taken when the rig is not on the well or when the rig is not in operation. wherein the first pressure reading from the first pressure sensor located at the wellhead and the second pressure reading from the second pressure sensor located at the adaptor or the spool enables identification of a completion state, a frack state, a static state, and a dynamic state of the well when the rig is not on the well or when the rig is not in operation, wherein the analysis of the operation of the well based on the remote sensor information includes determination that a frack well adjacent to the well is experiencing stress shadow risk of the well based on the first pressure reading and the second pressure reading being equal and being greater than static pressure.

2. The system of claim 1, wherein the set of sensors further includes one or more of a temperature sensor, a motion sensor, a location sensor, a valve position sensor, and/or a proximity sensor.

3. The system of claim 1, wherein the analysis of the operation of the well based on the remote sensor information includes benchmarking of flat time operations and/or offline operations based on the remote sensor information.

4. The system of claim 2, wherein the analysis of the operation of the well based on the remote sensor information includes monitoring of one or more well operation parameters based on the remote sensor information.

5. The system of claim 1, wherein the analysis of the operation of the well based on the remote senor information includes:

responsive to the remote sensor information providing information sufficient o determine well state, determination of the well state based on the remote sensor information; and responsive to the remote sensor information providing information insufficient to determine the well state, determination of the well state based on the remote sensor information and rig sensor information.

6. The system of claim 1, wherein the differentiation between the different types of well state includes differentiation between the completion state and the frack state of the well when the rig is not on the well or when the rig is not in operation based on the comparison of the first pressure reading from the first pressure sensor located at the wellhead and the second pressure reading from the second pressure sensor located at the adaptor or the spool.

7. The system of claim 1, wherein:

the set of sensors further includes a proximity sensor; and the analysis of the operation of the well based on the remote sensor information includes identification of the well based on an IP address conveyed by the remote sensor information.

8. The system of claim 1, wherein the differentiation between the different types of well state based on the comparison of the first pressure reading from the first pressure sensor located at the wellhead and the second pressure reading from the second pressure sensor located at the adaptor or the spool includes:

determination of a first well state of the well when the rig is not on the well or when the rig is not in operation based on the first pressure reading from the first pressure sensor located at the wellhead and the second pressure reading from the second pressure sensor located at the adaptor or the spool indicating that first pressure reading from the first pressure sensor and second pressure reading from the second pressure sensor are equal; and determination of a second well state of the well different from the first well state when the rig is not on the well or when the rig is not in operation based on the first pressure reading from the first pressure sensor located at the wellhead and the second pressure reading from the second pressure sensor located at the adaptor or the spool indicating that the first pressure reading from the first pressure sensor is greater than the second pressure reading from the second pressure sensor.

9. The system of claim 8, wherein:

the well state of the well is determined to be the static state when the rip is not on the well or when the rig is not in operation based on (1) the first pressure reading at the wellhead being within a threshold value of the second pressure reading at the adaptor or the spool; and (2) the second pressure reading being less than hydrostatic pressure of air gap of mud weight; and the well state of the well is determined to be the dynamic state when the rig is not on the well or when the rig is not in operation based on (1) the first pressure reading at the wellhead being within the threshold value of the second pressure reading at the adaptor or the spool, and (2) the second pressure reading being greater than hydrostatic pressure of air gap of mud weight.

10. The system of claim 8, wherein:

the remote sensor information for multiple wells is obtained, the multiple wells including a first well, a second well, and a third well;

the operation of the multiple wells is analyzed based on the remote sensor information, the analysis of the operation of the multiple wells based on the remote sensor information including determination that the first well is a frack well based on a first set of pressure readings at a first wellhead and a first adaptor or a first spool of the first well being equal and being within a frack pressure range.

11. The system of claim 10, wherein the analysis of the operation of the multiple wells based on the remote sensor information further includes determination that the second well is undergoing a wireline operation based on a second set of pressure readings at a second wellhead and a second adaptor or a second spool of the second well being equal and matching a wireline pump down pressure.

12. The system of claim 11, wherein the analysis of the operation of the multiple wells based on the remote sensor information further includes determination that the third well is a static well based on a third set of pressure readings at a third wellhead and a third adaptor or a third spool of the third well being equal, and the third set of pressure readings at the third wellhead and the third adaptor or the third spool of the well not being equal to the first set of pressure readings or the second set of pressure readings.

13. A method for analyzing well operations, the method comprising:

obtaining remote sensor information for a well, the well including a wellhead, a blowout preventor or a tree attached to the wellhead via an adaptor or a spool, the remote sensor information generated by a set of sensors including a first pressure sensor located at the wellhead and a second pressure sensor located at the adaptor or the spool, the set of sensors operating independently of a rig of the well to generate the remote sensor information when the rig is not on the well or when the rig is not in operation, the remote sensor information characterizing one or more operating characteristics of the well and enabling analysis of operation of the well to differentiate between different types of well state when the rig is not on the well or when the rig is not in operation the remote sensor information including a first pressure reading from the first pressure sensor located at the wellhead and a second pressure reading from the second pressure sensor located at the adaptor or the spool; and analyzing the operation of the well based on the remote sensor information, the analysis of the operation of the well based on the remote sensor information including differentiation between the different types of well state based on comparison of the first pressure reading from the first pressure sensor located at the wellhead and the second pressure reading from the second pressure sensor located at the adaptor or the spool, the first pressure reading and the second pressure reading taken when the rig is not on the well or when the rig is not in operation, wherein the first pressure reading from the first pressure sensor located at the wellhead and the second pressure reading from the second pressure sensor located at the adaptor or the spool enables identification of a completion state, a frack state, a static state, and a dynamic state of the well when the rig is not on the well or when the rig is not in operation, wherein the analysis of the operation of the well based on the remote sensor information includes determination that a frack well adjacent to the well is experiencing stress shadow risk of the well based on the first pressure reading and the second pressure reading being equal and being greater than static pressure.

14. The method of claim 13, wherein the set of sensors further includes one or more of a temperature sensor, a motion sensor, a location sensor, a valve position sensor, and/or a proximity sensor.

15. The method of claim 14, wherein analyzing the operation of the well based on the remote sensor information includes benchmarking of flat time operations and/or offline operations based on the remote sensor information.

16. The method of claim 14, wherein analyzing the operation of the well based on the remote sensor information includes monitoring of one or more well operation parameters based on the remote sensor information.

17. The method of claim 13, wherein analyzing the operation of the well based on the remote senor information includes:

responsive to the remote sensor information providing information sufficient to determine well state, determining the well state based on the remote sensor information; and responsive to the remote sensor information providing information insufficient to determine the well state, determining the well state based on the remote sensor information and rig sensor information.

18. The method of claim 13, wherein the differentiation between the different types of well state includes differentiation between the completion state and the frack state of the well when the rig is not on the well or when the rig is not in operation based on the comparison of the first pressure reading from the first pressure sensor located at the wellhead and the second pressure reading from the second pressure sensor located at the adaptor or the spool.

19. The method of claim 13, wherein:

the set of sensors further includes a proximity sensor; and analyzing the operation of the well based on the remote sensor information includes identification of the well based on an IP address conveyed by the remote sensor information.

* * * * *